US009691326B2

(12) United States Patent
Lee

(10) Patent No.: US 9,691,326 B2
(45) Date of Patent: Jun. 27, 2017

(54) DISPLAY DEVICE

(71) Applicant: SAMSUNG DISPLAY CO., LTD., Yongin, Gyeonggi-Do (KR)

(72) Inventor: Gi Chang Lee, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 63 days.

(21) Appl. No.: 14/339,404

(22) Filed: Jul. 23, 2014

(65) Prior Publication Data

US 2015/0248862 A1 Sep. 3, 2015

(30) Foreign Application Priority Data

Feb. 28, 2014 (KR) ..... 10-2014-0024335

(51) Int. Cl.

| | |
|---|---|
| ***G09G 3/30*** | (2006.01) |
| ***G09G 3/3258*** | (2016.01) |
| ***G09G 3/20*** | (2006.01) |

(52) U.S. Cl.

CPC ..... *G09G 3/3258* (2013.01); *G09G 3/2022* (2013.01); *G09G 2300/0465* (2013.01);

(Continued)

(58) Field of Classification Search

CPC ..... G09G 3/2018; G09G 3/2022; G09G 3/30; G09G 3/3208; G09G 3/3225;

(Continued)

(56) References Cited

U.S. PATENT DOCUMENTS 8,237,634 B2 * 8/2012 Kwak ..... G09G 3/3233 345/211
8,736,597 B2 * 5/2014 Kim ..... G09G 3/3258 345/214

(Continued)

FOREIGN PATENT DOCUMENTS

KR 10-2006-0040907 A 5/2006
KR 10-2010-0070857 A 6/2010

OTHER PUBLICATIONS

Mizukami, M., et al., *36.1: 6-Bit Digital VGA OLED*. SID Symposium Digest of Technical Papers. vol. 31, Issue 1, pp. 912-915, May 2000.

*Primary Examiner* — Jason Mandeville
(74) *Attorney, Agent, or Firm* — Lewis Roca Rothgerber Christie LLP

(57) ABSTRACT

Provided is a display device including: a plurality of pixels, each of the pixels including: a first switching transistor including a gate electrode coupled to a scan line, a first electrode coupled to a data line, and a second electrode coupled to a first node; a first driving voltage transistor including a gate electrode coupled to the first node, and a first electrode coupled to a first driving voltage; a write transistor including a gate electrode coupled to a write line, a first electrode coupled to a second electrode of the first driving voltage transistor, and a second electrode coupled to a second node; a second switching transistor including a gate electrode coupled to the second node, a first electrode coupled to a first power voltage, and a second electrode coupled to an organic light emitting diode; and a first capacitor coupled between the first node and the second node.

10 Claims, 13 Drawing Sheets

(52) U.S. Cl.
CPC ..... *G09G 2300/0852* (2013.01); *G09G 2330/021* (2013.01)

(58) Field of Classification Search
CPC ..... G09G 3/3258; G09G 3/3291; G09G 2300/08; G09G 2300/0809; G09G 2300/0814; G09G 2300/0819; G09G 2300/0876; G09G 2320/0252; G09G 2330/021
USPC ..... 345/76–78
See application file for complete search history.

(56) References Cited

U.S. PATENT DOCUMENTS

| | | | | |
|---|---|---|---|---|
| 2003/0011584 | A1* | 1/2003 | Azami | G09G 3/3258 345/204 |
| 2007/0126666 | A1* | 6/2007 | Yamazaki | G09G 3/2022 345/76 |
| 2011/0096066 | A1 | 4/2011 | Thompson et al. | |
| 2011/0279433 | A1* | 11/2011 | Ryu | G09G 3/3233 345/211 |

* cited by examiner

DISPLAY DEVICE

CROSS-REFERENCE TO RELATED APPLICATION

This application claims priority to and the benefit of Korean Patent Application No. 10-2014-0024335 filed in the Korean Intellectual Property Office on Feb. 28, 2014, the entire contents of which are incorporated herein by reference.

BACKGROUND

1. Field

Aspects of embodiments of the present invention relate to a display device. More particularly, aspects of embodiments of the present invention relate to a digital driving type of display device.

2. Description of the Related Art

Recently, display devices such as a liquid crystal display, a field emission display, a plasma display panel, and an organic light emitting display have been commercially available.

A display device includes a display panel formed of a plurality of pixels arranged in a matrix format. A display panel includes a plurality of scan lines formed in a row direction and a plurality of data lines formed in a column line, and the plurality of scan lines and the plurality of data lines are arranged to cross each other. Each of the plurality of pixels is driven by a scan signal and a data signal respectively transmitted from a corresponding scan line and data line.

The display device is classified into a passive matrix type of light emitting display device and an active matrix type of light emitting display device depending on the method of driving the pixels. In view of resolution, contrast, and response time, the trend is towards the active matrix type where the respective unit pixels are selectively turned on or off.

The active matrix type of light emitting display device is generally applied with an analog driving method or a digital driving method. While the analog driving method is a method of expressing a grayscale level as a level of the data voltage, the digital driving method is a method of expressing the grayscale level by a time or a number of times that the data voltage is applied while a data voltage level is constantly maintained.

It is usual in an analog driving scheme to install a compensation circuit for compensating a dispersion characteristic of a threshold voltage of a driving transistor for controlling a current amount of a driving current flowing to a light-emitting device in a pixel. The analog driving scheme reduces a time that is allocated when a data signal is applied to each pixel as a resolution of the display device is increased. Accordingly, a voltage range of the data signal is reduced and the display device becomes more sensitive to a process variation of the driving transistor.

On the contrary, the digital driving scheme is not as sensitive to the process variation of the driving transistor since the data signal has an on-off voltage.

However, the digital driving scheme has a greater number of times of charging and discharging the data line and also has a greater voltage range of the data signal compared to the analog driving scheme. Accordingly, the digital driving scheme has very high power consumption compared to the analog driving scheme. For example, a voltage difference between a minimum voltage of the data signal and a maximum voltage is 3 V according to the analog driving scheme, while the voltage difference between the minimum voltage and the maximum voltage is 10 V according to the digital driving scheme. The digital driving scheme has eight to ten times the number of charges and discharges of the data line compared to the analog driving scheme. By the difference, the digital driving scheme has about 90 times the power consumption for driving compared to the analog driving scheme.

Further, the digital driving scheme requires about ⅛-1/10 the time for inputting the data signal into respective pixels compared to the analog driving scheme, thereby lacking a time margin for inputting the data signal. To overcome the insufficiency of the time margin, a method for reducing wire resistance by increasing wiring thicknesses of the data line and the scan line is used to reduce a delay caused by the wire.

However, there is a limit in the process in the case of increasing the thickness of wiring, and when the thickness of wiring is increased, a time for manufacturing the display device is increased which may become a factor for reducing productivity of the display device.

The above information disclosed in this Background section is only for enhancement of understanding of the background of the invention and therefore it may contain information that does not form the prior art that is known to a person of ordinary skill in the art.

SUMMARY

Aspects of embodiments of the present invention relate to a digital driving display device for reducing power consumption, and acquiring a time margin for inputting a data signal without increasing a thickness of wiring.

An embodiment of the present invention provides a display device including: a plurality of pixels, each of the pixels including: a first switching transistor including a gate electrode coupled to a scan line, a first electrode coupled to a data line, and a second electrode coupled to a first node; a first driving voltage transistor including a gate electrode coupled to the first node, and a first electrode coupled to a first driving voltage; a write transistor including a gate electrode coupled to a write line, a first electrode coupled to a second electrode of the first driving voltage transistor, and a second electrode coupled to a second node; a second switching transistor including a gate electrode coupled to the second node, a first electrode coupled to a first power voltage, and a second electrode coupled to an organic light emitting diode; and a first capacitor including a first electrode coupled to the first node and a second electrode coupled to the second node.

Each of the pixels may further include a second driving voltage transistor including a gate electrode coupled to the scan line, a first electrode coupled to a second driving voltage, and a second electrode coupled to the second node.

Each of the pixels may further include a second capacitor including a first electrode coupled to the first power voltage and a second electrode coupled to the second node.

The first driving voltage may be a gate-on voltage for turning on the second switching transistor.

The second driving voltage may be a gate-off voltage for turning off the second switching transistor.

A data signal with a white voltage for turning on the first driving voltage transistor or a black voltage for turning off the first driving voltage transistor may be applied to the data line.

During a reset period, a scan signal with a gate-on voltage may be applied to the scan line and the data signal may be applied to the data line, and during a data write period, a scan signal with a gate-off voltage may be applied to the scan line and a write signal may be applied as a gate-on voltage to the write line.

When the data signal is applied as the white voltage, a voltage at the first node may changed to a voltage for turning on the first driving voltage transistor by a bootstrap effect caused by the first capacitor during the data write period.

The reset period and the data write period may have the same period.

The write signal may be another scan signal that is output to a row line next to a row line to which the scan signal is applied.

The data write period may have a period that is longer than the reset period.

A second power voltage coupled to a cathode of the organic light emitting diode may be applied as a same voltage as the first power voltage during the data write period, and after the data write period, the second power voltage may be changed and the organic light emitting diode may emit light.

Another embodiment of the present invention provides a display device including: a plurality of pixels, each of the pixels including: a first switching transistor including a gate electrode coupled to a second scan line, a first electrode coupled to a data line, and a second electrode coupled to a first node; a first driving voltage transistor including a gate electrode coupled to the first node, a first electrode coupled to a first driving voltage, and a second electrode coupled to a second node; a second driving voltage transistor including a gate electrode coupled to a first scan line, a first electrode coupled to a second driving voltage, and a second electrode coupled to the second node; and a second switching transistor including a gate electrode coupled to the second node, a first electrode coupled to a first power voltage, and a second electrode coupled to an organic light emitting diode.

The first driving voltage transistor may include a channel that is different from that of the first switching transistor, the second switching transistor, and the second driving voltage transistor.

The first switching transistor, the second switching transistor, and the second driving voltage transistor may include p-channel electric field effect transistors, and the first driving voltage transistor may include an n-channel electric field effect transistor.

Each of the pixels may further include a capacitor including a first electrode coupled to the first power voltage and a second electrode coupled to the second node.

The first driving voltage may be a gate-on voltage for turning on the second switching transistor.

The second driving voltage may be a gate-off voltage for turning off the second switching transistor.

A data signal with a white voltage for turning on the first driving voltage transistor or a black voltage for turning off the first driving voltage transistor may be applied to the data line.

During a reset period, a first scan signal with a gate-on voltage may be applied to the first scan line and the second node may be reset with the second driving voltage, and during a data write period, a second scan signal with a gate-on voltage may be applied to the second scan line and the data signal may be applied to the data line.

According to example embodiments of the present invention, power consumption of the digital driving based display device may be reduced.

According to example embodiments of the present invention, there is no need to increase the thickness of wiring of the scan line and the data line for the purpose of acquiring the time margin for inputting the data signal, thereby reducing the time for manufacturing the display device and improving productivity.

DETAILED DESCRIPTION

Figure 1:
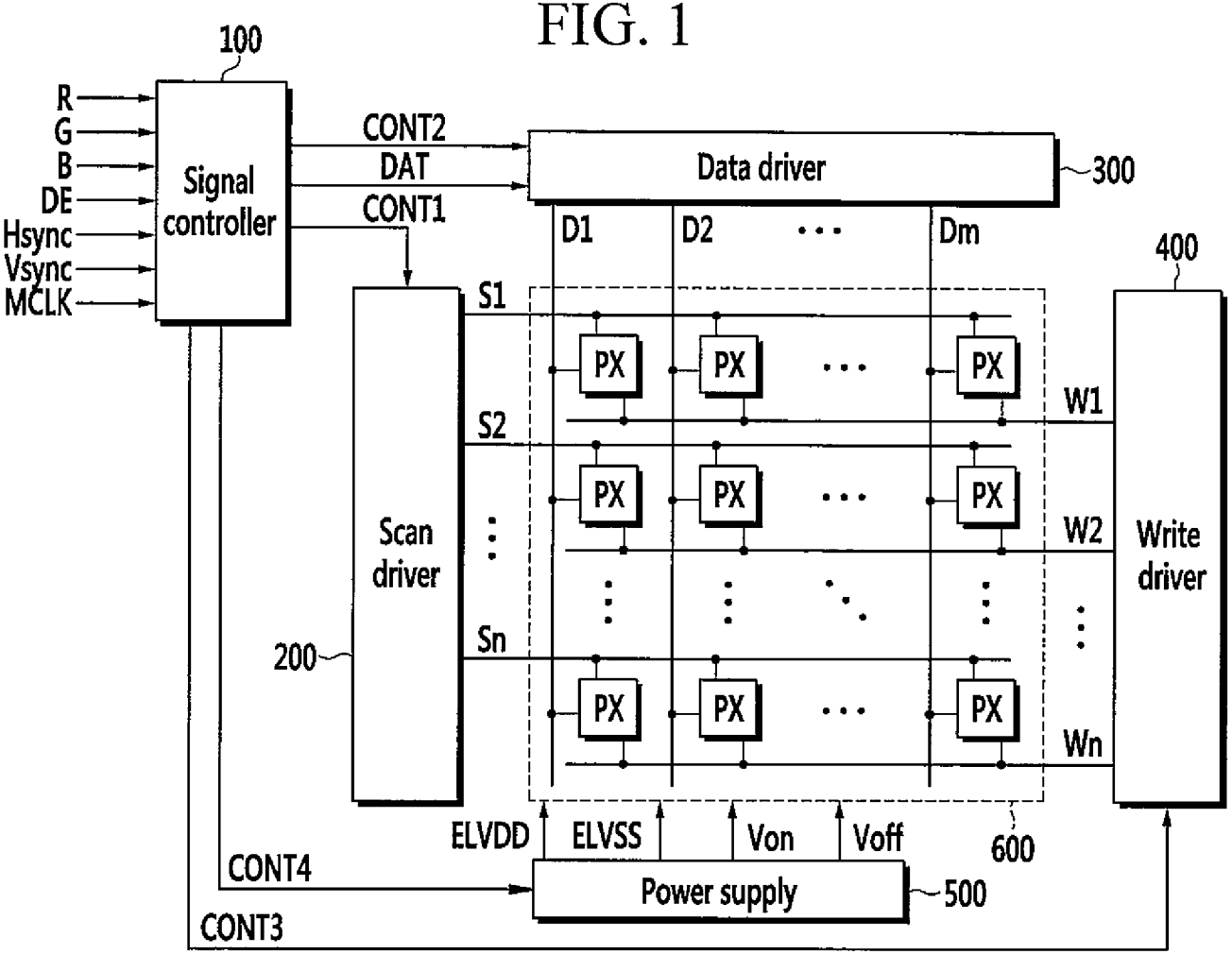
FIG. 1 shows a block diagram of a display device according to an example embodiment of the present invention.

Aspects of the present invention will be described more fully hereinafter with reference to the accompanying drawings, in which example embodiments of the present invention are shown. As those skilled in the art would realize, the described embodiments may be modified in various different ways, all without departing from the spirit or scope of the present invention.

Further, in the embodiments, like reference numerals designate like elements throughout the specification representatively in a first embodiment, and only elements of other embodiments that are not substantially the same as those of the first embodiment will be described.

Descriptions of parts not related to aspects of the present invention are omitted, and like reference numerals designate like elements throughout the specification.

Throughout this specification and the claims that follow, when it is described that an element is "coupled" to another element, the element may be "directly coupled" to the other element or "electrically coupled" or "indirectly coupled" to the other element through one or more intervening elements. In addition, unless explicitly described to the contrary, the word "comprise" and variations such as "comprises" or "comprising" will be understood to imply the inclusion of the stated elements but not the exclusion of any other elements.

FIG. 1 shows a block diagram of a display device according to an example embodiment of the present invention.

Referring to FIG. 1, the display device includes a signal controller 100, a scan driver 200, a data driver 300, a write driver 400, a power supply 500, and a display unit 600.

The signal controller 100 receives video signals R, G, and B, and an input control signal for controlling the video signals R, G, and B from an external device. The video signals R, G, and B include luminance information of respective pixels (PX), and the luminance has a predetermined number, for example, $1024=2^{10}$, $256=2^{8}$, or $64=2^{6}$, of grays (e.g., gray levels). Input control signals, for example, include a vertical synchronization signal Vsync, a horizontal synchronization signal Hsync, a main clock signal MCLK, and a data enable signal DE.

The signal controller 100 appropriately processes the image signals R, G, and B according to operating conditions of the display unit 600 and the data driver 300, based on the image signals R, G, and B and the input control signal. The signal controller 100 generates a scan control signal CONT1, a data control signal CONT2, a write control signal CONT3, a power control signal CONT4, and an image data signal DAT. The signal controller 100 transmits the scan control signal CONT1 to the scan driver 200. The signal controller 100 transmits the data control signal CONT2 and the image data signal DAT to the data driver 300. The signal controller 100 transmits the write control signal CONT3 to the write driver 400. The signal controller 100 transmits the power control signal CONT4 to the power supply 500.

The display unit 600 includes a plurality of scan lines (S1-Sn), a plurality of data lines (D1-Dm), a plurality of write lines (W1-Wn), and a plurality of pixels PX coupled to (e.g., connected to) the signal lines (S1-Sn, D1-Dm, and W1-Wn) and substantially arranged in a matrix form. The scan lines (S1-Sn) are substantially extended in a row direction and are substantially parallel with each other. The data lines (D1-Dm) are substantially extended in a column direction and are substantially parallel with each other. The write lines (W1-Wn) are substantially extended in a row direction and are substantially parallel with each other.

The scan driver 200 is coupled to the scan lines (S1-Sn), and applies a scan signal that is a combination of a gate-on voltage and a gate-off voltage to the scan lines (S1-Sn) according to the scan control signal CONT1. The scan driver 200 may sequentially apply the scan signal to a plurality of scan lines (S1-Sn).

The data driver 300 is coupled to the data lines (D1-Dm), and selects an input time or an input number of times of the data signal according to the image data signal DAT. The data signal may include a white voltage and a black voltage. The data driver 300 applies a data signal to the data lines (D1-Dm) according to an input time or an input number of times of the data signal selected by the data control signal CONT2.

The write driver 400 is coupled to the write lines (W1-Wn), and applies a write signal that is a combination of the gate-on voltage and the gate-off voltage to the write lines (W1-Wn) according to the write control signal CONT3. The write driver 400 may sequentially apply the write signal to the write lines (W1-Wn). The write driver 400 may be omitted depending on the method for driving a display device.

The power supply 500 supplies a first power voltage (ELVDD) and a second power voltage (ELVSS) for driving the plurality of pixels PX to the display unit 600. The power supply 500 supplies a first driving voltage Von and a second driving voltage Voff for turning on/off transistors included in the plurality of pixels PX to the display unit 600. The power supply 500 may change at least one level of the first power voltage (ELVDD) and second power voltage (ELVSS) according to the power control signal CONT4.

The above-described driving devices (100, 200, 300, 400, and 500) may be mounted as at least one IC chip on the display unit 600, mounted on a flexible printed circuit film, attached as a tape carrier package (TCP) on the display unit 600, mounted on an additional printed circuit board (PCB), or integrated on the display unit 600 together with the signal lines (S1-Sn, D1-Dm, and W1-Wn).

Figure 2:
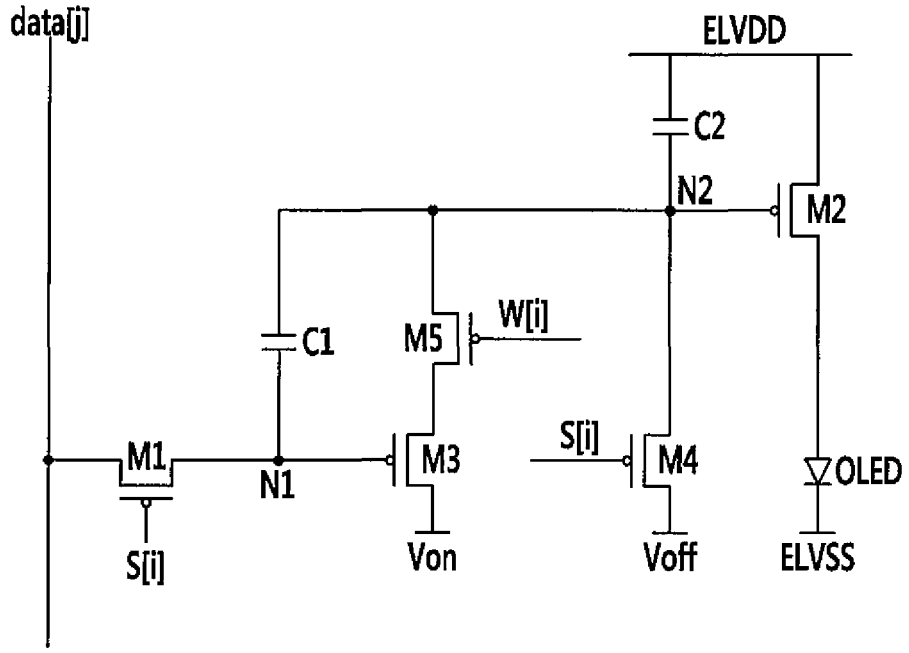
FIG. 2 shows a circuit diagram of a pixel according to an example embodiment of the present invention.

FIG. 2 shows a circuit diagram of a pixel according to an example embodiment of the present invention. A pixel provided on an i-th row and a j-th column is illustrated ($1 \le i \le n$, $1 \le j \le m$).

Referring to FIG. 2, the pixel includes a first switching transistor M1, a second switching transistor M2, a first driving voltage transistor M3, a second driving voltage transistor M4, a write transistor M5, a first capacitor C1, a second capacitor C2, and an organic light emitting diode (OLED).

The first switching transistor M1 includes a gate electrode coupled (e.g., connected) to a scan line, a first electrode coupled to a data line, and a second electrode coupled to a first node N1. A scan signal (S[i]) is applied to the gate electrode of the first switching transistor M1 through the scan line. A data signal (data[j]) is applied to the first electrode of the first switching transistor M1 through the data line. The first switching transistor M1 is turned on by the scan signal (S[i]) applied to the scan line, and then applies the data signal (data[j]) to the first node N1.

The second switching transistor M2 includes a gate electrode coupled to a second node N2, a first electrode coupled to a first power voltage (ELVDD), and a second electrode coupled to the organic light emitting diode (OLED). The second switching transistor M2 is turned on by a voltage at the second node N2, and then applies the first power voltage (ELVDD) to the organic light emitting diode (OLED).

The first driving voltage transistor M3 includes a gate electrode coupled to the first node N1, a first electrode coupled to a first driving voltage Von, and a second electrode coupled to a first electrode of the write transistor M5. The first driving voltage transistor M3 is turned on by a voltage Vn1 at the first node N1, and applies the first driving voltage Von to the write transistor M5. The first driving voltage Von may be a gate-on voltage for turning on the second switching transistor M2.

The second driving voltage transistor M4 includes a gate electrode coupled to the scan line, a first electrode coupled to a second driving voltage Voff, and a second electrode coupled to the second node N2. The second driving voltage transistor M4 is turned on by the scan signal (S[i]) applied to the scan line, and applies the second driving voltage Voff to the second node N2. The second driving voltage Voff may be a gate-off voltage for turning off the second switching transistor M2.

The write transistor M5 includes a gate electrode coupled to a write line, a first electrode coupled to the second electrode of the first driving voltage transistor M3, and a second electrode coupled to the second node N2. The write transistor M5 is turned on by the write signal (W[i]) applied through the write line, and then applies the first driving voltage Von provided through the first driving voltage transistor M3 to the second node N2.

The first capacitor C1 includes a first electrode coupled to the first node N1 and a second electrode coupled to the second node N2.

The second capacitor C2 includes a first electrode coupled to the first power voltage (ELVDD) and a second electrode coupled to the second node N2.

The organic light emitting diode (OLED) includes an anode coupled to the second electrode of the second switching transistor M2, and a cathode coupled to a second power voltage (ELVSS). The organic light emitting diode (OLED) may emit one light of primary colors. The primary colors may include red, green, and blue, and desired colors may be displayed by a spatial sum or a temporal sum of these three primary colors.

An organic emission layer of the organic light emitting diode (OLED) may be formed with a low-molecule organic material or a high-molecule organic material such as poly (3,4-ethylenedioxythiophene) (PEDOT). Also, the organic emission layer may be formed with multiple layers including an emission layer and at least one of a hole injection layer (HIL), a hole transport layer (HTL), an electron transport layer (ETL), and an electron injection layer (EIL). In the case where the organic emission layer includes all the layers, the hole injection layer (HIL) is disposed on a pixel electrode which is an anode, and the hole transporting layer (HTL), the emission layer, the electron transporting layer (ETL), and the electron injection layer (EIL) are sequentially laminated thereon.

The organic emission layer may include a red organic emission layer for emitting red light, a green organic emission layer for emitting green light, or a blue organic emission layer for emitting blue light. The red organic emission layer, the green organic emission layer, and the blue organic emission layer are formed in a red pixel, a green pixel, and a blue pixel, respectively, thereby realizing various color images.

Further, the organic emission layer may realize a color image by laminating the red organic emission layer, the green organic emission layer, and the blue organic emission layer together in the red pixel, the green pixel, and the blue pixel, and forming a red color filter, a green color filter, and a blue color filter for each pixel. As another example, white organic emission layers emitting white light are formed in all of the red pixel, the green pixel, and the blue pixel, and a red color filter, a green color filter, and a blue color filter are formed for each pixel, thereby implementing the color image. In the case of implementing the color image by using the white organic emission layer and the color filters, a deposition mask for depositing the red organic emission layer, the green organic emission layer, and the blue organic emission layer on respective pixels, that is, the red pixel, the green pixel, and the blue pixel, may not need to be used.

The white organic emission layer described in another example embodiment may be formed to have a single organic emission layer, and may further include a configuration in which a plurality of organic emission layers are laminated to emit white light. For example, a configuration in which at least one yellow organic emission layer and at least one blue organic emission layer are combined to emit white light, a configuration in which at least one cyan organic emission layer and at least one red organic emission layer are combined to emit white light, or a configuration in which at least one magenta organic emission layer and at least one green organic emission layer are combined to emit white light may be further included.

The first switching transistor M1, the second switching transistor M2, the first driving voltage transistor M3, the second driving voltage transistor M4, and the write transistor M5 may be p-channel electric field effect transistors. In this case, the gate-on voltage for turning on the p-channel electric field effect transistors is a low level voltage, and the gate-off voltage for turning them off is a high level voltage.

The p-channel electric field effect transistors have been described in the above description, but the present invention is not limited thereto, and at least one of the first switching transistor M1, the second switching transistor M2, the first driving voltage transistor M3, the second driving voltage transistor M4, and the write transistor M5 may be an n-channel electric field effect transistor. In this case, the gate-on voltage for turning on the n-channel electric field effect transistor is a high level voltage and the gate-off voltage for turning it off is a low level voltage.

An operation for applying a data signal with a white voltage to a pixel of FIG. 2 will now be described with reference to FIG. 3 to FIG. 6, and an operation for applying a data signal with a black voltage to a pixel of FIG. 2 will be described with reference to FIG. 7 and FIG. 8.

Figure 3:
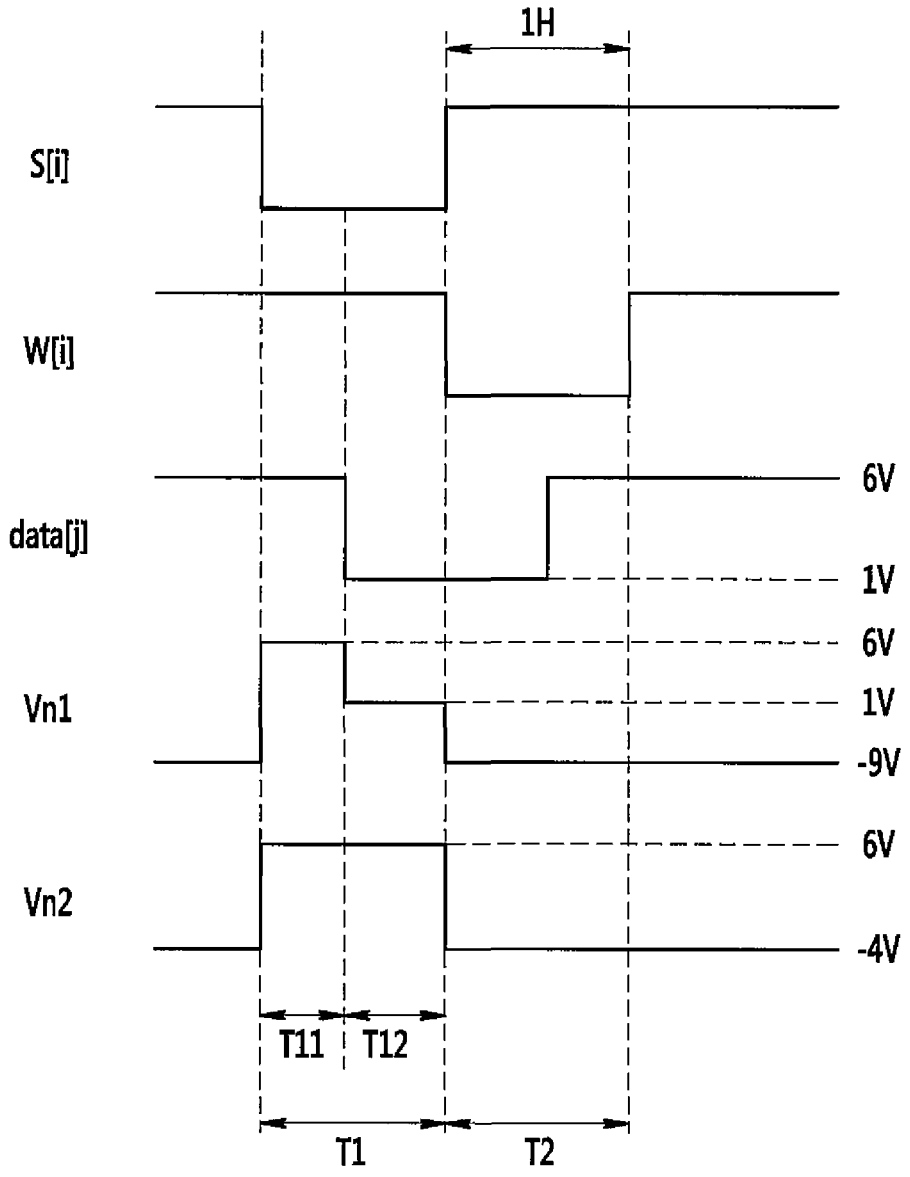
FIG. 3 shows a timing diagram for an operation of applying a data signal with a white voltage to a pixel according to an example embodiment of the present invention.
Figure 4:
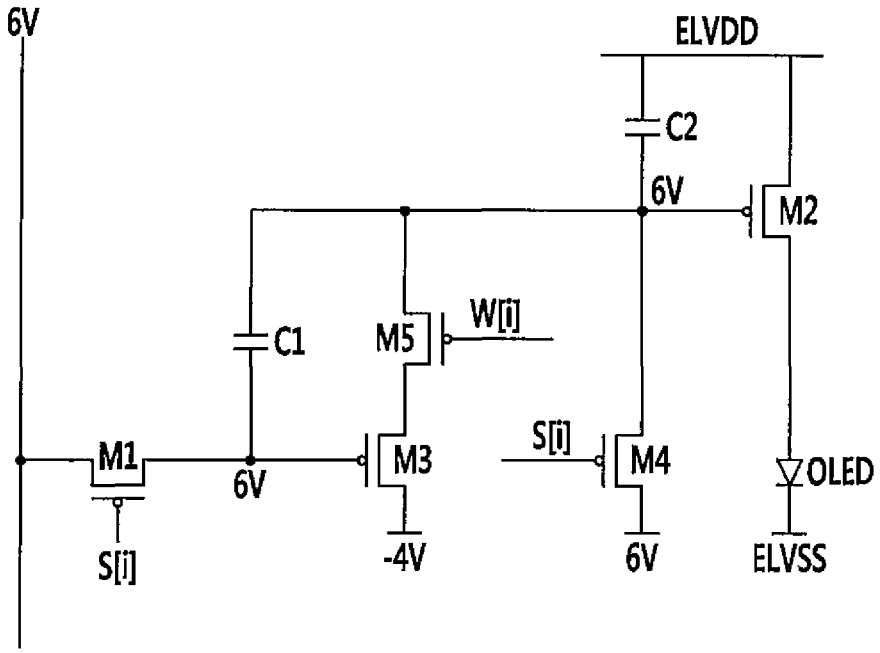
FIG. 4 shows a circuit diagram for a first operation of applying a data signal with a white voltage to a pixel according to an example embodiment of the present invention.
Figure 5:
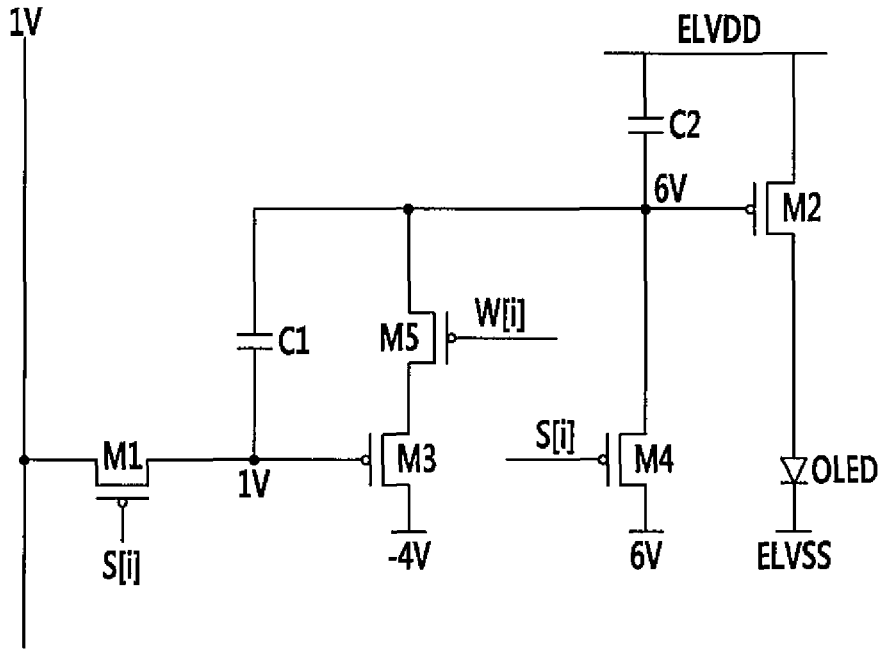
FIG. 5 shows a circuit diagram for a second operation of applying a data signal with a white voltage to a pixel according to an example embodiment of the present invention.
Figure 6:
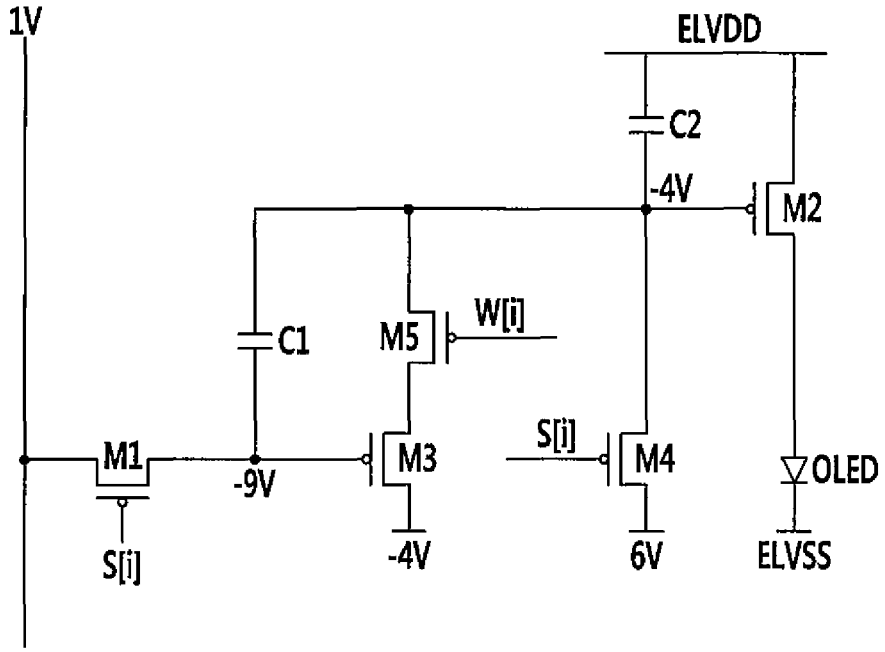
FIG. 6 shows a circuit diagram for a third operation of applying a data signal with a white voltage to a pixel according to an example embodiment of the present invention.

FIG. 3 shows a timing diagram for an operation of applying a data signal with a white voltage to a pixel according to an example embodiment of the present invention. FIG. 4 shows a circuit diagram for a first operation of applying a data signal with a white voltage to a pixel according to an example embodiment of the present invention. FIG. 5 shows a circuit diagram for a second operation of applying a data signal with a white voltage to a pixel according to an example embodiment of the present invention. FIG. 6 shows a circuit diagram for a third operation of applying a data signal with a white voltage to a pixel according to an example embodiment of the present invention.

Referring to FIG. 3 to FIG. 6, the operation for applying a data signal to a pixel includes a reset period T1 and a data write period T2. The reset period T1 is a period for resetting a voltage Vn2 at the second node N2 with the second driving voltage Voff. The data write period T2 is a period for applying the first driving voltage Von or the second driving voltage Voff to the second node N2 corresponding to the data signal. The first driving voltage Von may be a low level voltage (e.g., −4 V), and the second driving voltage Voff may be a high level voltage (e.g., 6 V). The reset period T1 and the data write period T2 may correspond to a first horizontal period 1H. The first horizontal period 1H is equal to or substantially equal to periods of the horizontal synchronizing signal Hsync and the data enable signal DE.

During the reset period T1, the scan signal (S[i]) is applied as the gate-on voltage, and the write signal (W[i]) is applied as the gate-off voltage. The data signal (data[j]) is applied as a black voltage for a first reset period T11 (e.g., a predetermined first reset period), and the data signal (data[j]) is applied as a white voltage for a second reset period T12 that is provided after the first reset period T11. The first reset period T11 and the second reset period T12 are included in the reset period T1. The black voltage is a high level voltage (e.g., 6 V), for turning off the first driving voltage transistor M3, and the white voltage is a low level voltage (e.g., 1 V), for turning on the first driving voltage transistor M3.

As shown in FIG. 4, the scan signal (S[i]) is applied as the gate-on voltage during the first reset period T11 so the first switching transistor M1 and the second driving voltage transistor M4 are turned on. The data signal (data[j]) having a black voltage is applied to the first node N1 through the turned on first switching transistor M1, and the voltage Vn1 at the first node N1 becomes 6 V. The second driving voltage Voff is applied to the second node N2 through the turned on second driving voltage transistor M4, and the voltage Vn2 at the second node N2 becomes 6 V.

As shown in FIG. 5, the data signal (data[j]) is varied into the white voltage during the second reset period T12. The data signal (data[j]) with a white voltage is applied to the first node N1 through the turned on first switching transistor M1, and the voltage Vn1 at the first node N1 becomes 1 V.

As shown in FIG. 6, the scan signal (S[i]) is applied as the gate-off voltage for the data write period T2, and the write signal (W[i]) is applied as the gate-on voltage. When the scan signal (S[i]) is applied as the gate-off voltage, the first switching transistor M1 and the second driving voltage transistor M4 are turned off. When the first switching transistor M1 is turned off, the first node N1 floats. When the write signal (W[i]) is applied as the gate-on voltage, the write transistor M5 is turned on. When the write transistor M5 is turned on, the first driving voltage transistor M3 is turned on by a bootstrap effect caused by the first capacitor C1. The first driving voltage Von is applied to the second node N2, the voltage Vn2 at the second node N2 becomes −4 V, and the voltage Vn1 at the first node N1 is reduced to −9 V by the bootstrap effect caused by the first capacitor C1. The voltage Vn2 at the second node N2 is stored in the second capacitor C2, and the second capacitor C2 maintains the second switching transistor M2 in a turned on state. When the second switching transistor M2 is turned on by the voltage Vn2 at the second node N2, a current flows to the organic light emitting diode (OLED) from the first power voltage (ELVDD), and the organic light emitting diode (OLED) emits light.

A time for the organic light emitting diode (OLED) to emit light is controllable by one of the first power voltage (ELVDD) and the second power voltage (ELVSS). For example, the first power voltage (ELVDD) may be 5 V, and the second power voltage (ELVSS) may be changed to 5 V from 0 V. When the second power voltage (ELVSS) is applied with 5 V, which is equal to the first power voltage (ELVDD), during the reset period T1 and the data write period T2, the current does not flow to the organic light emitting diode (OLED) when the second switching transistor M2 is turned on, so the organic light emitting diode (OLED) emits no light. When the second power voltage (ELVSS) is changed to 0 V, the current flows to the organic light emitting diode (OLED) which then emits light.

Figure 7:
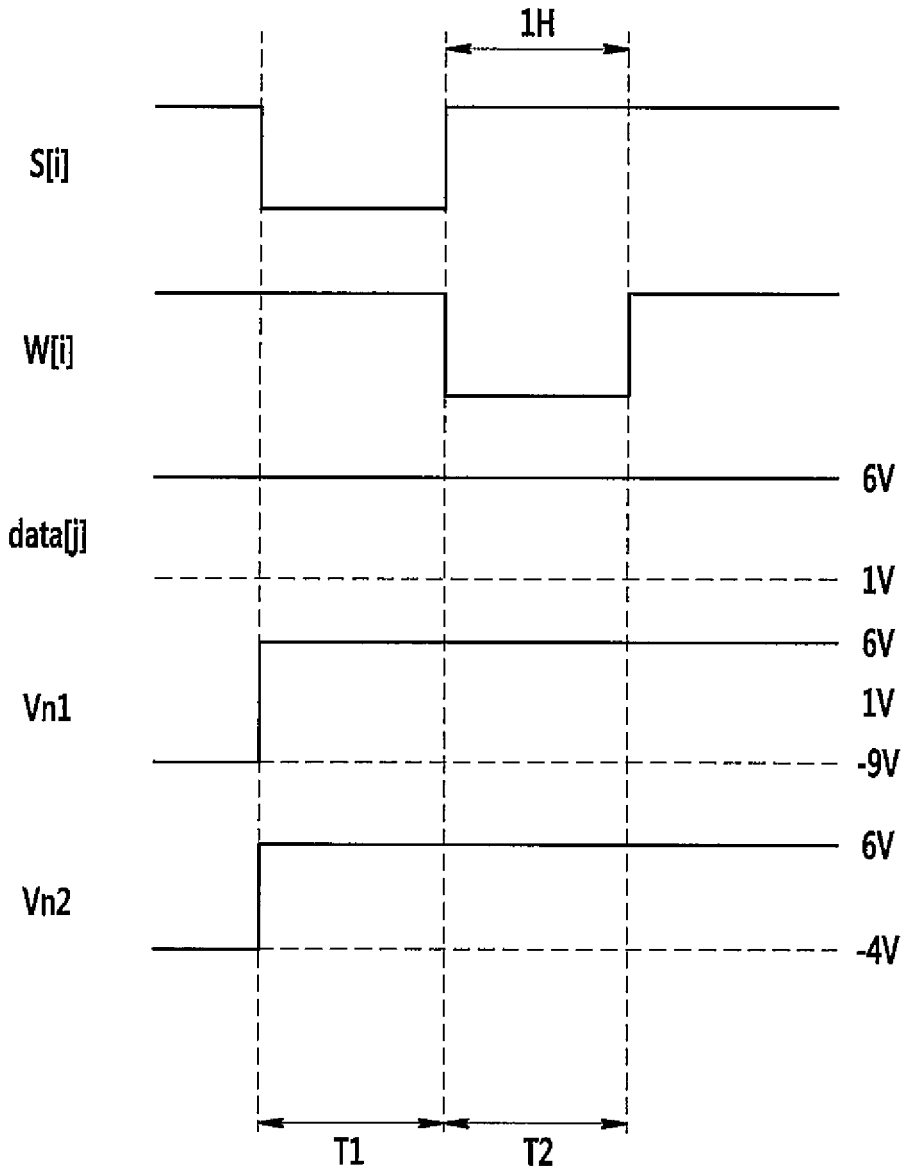
FIG. 7 shows a timing diagram for an operation of applying a data signal with a black voltage to a pixel according to an example embodiment of the present invention.

FIG. 7 shows a timing diagram for an operation of applying a data signal with a black voltage to a pixel according to an example embodiment of the present invention. FIG. 8 shows a circuit diagram for an operation of applying a data signal with a black voltage to a pixel according to an example embodiment of the present invention.

Figure 8:
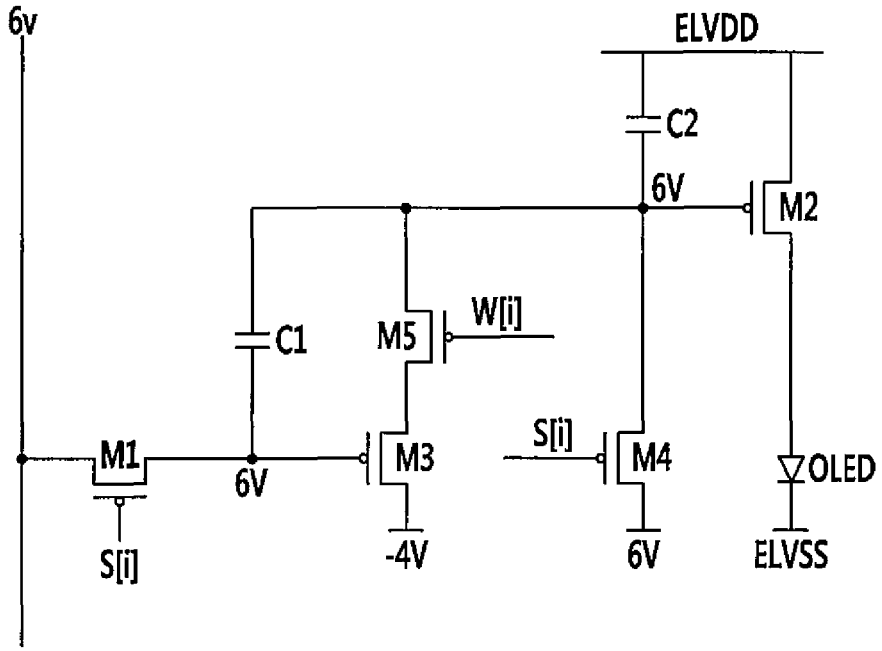
FIG. 8 shows a circuit diagram for an operation of applying a data signal with a black voltage to a pixel according to an example embodiment of the present invention.

Referring to FIG. 7 and FIG. 8, during the reset period T1, the scan signal (S[i]) is applied as the gate-on voltage, and the write signal (W[i]) is applied as the gate-off voltage. During the data write period T2, the scan signal (S[i]) is applied as the gate-off voltage, and the write signal (W[i]) is applied as the gate-on voltage. In this case, the data signal (data[j]) is applied as 6 V, a black voltage, during the reset period T1 and the data write period T2.

During the reset period T1, the first switching transistor M1 and the second driving voltage transistor M4 are turned on. The data signal (data[j]) having the black voltage is applied to the first node N1 through the turned on first switching transistor M1, and the voltage Vn1 at the first node N1 becomes 6 V. The second driving voltage Voff is applied to the second node N2 through the turned on second driving voltage transistor M4, and the voltage Vn2 at the second node N2 becomes 6 V.

During the data write period T2, the first switching transistor M1 and the second driving voltage transistor M4 are turned off, and the write transistor M5 is turned on. Since the voltage Vn1 at the first node N1 is 6 V that is a high level voltage for turning off the first driving voltage transistor M3, the first driving voltage transistor M3 is turned off. The voltage Vn2 at the second node N2 maintains 6 V and the second switching transistor M2 is turned off. Hence, no current flows to the organic light emitting diode (OLED) from the first power voltage (ELVDD).

As described above, the write signal (W[i]) is applied to the gate electrode of the write transistor M5 included in the pixel of FIG. 2. However, the present invention is not limited thereto. For example, when the reset period T1 and the data write period T2 have the first horizontal period 1H as the same period, a scan signal S[i+1] (e.g., a next scan signal or another scan signal) other than the write signal (W[i]) may be applied to the gate electrode of the write transistor M5. The scan signal S[i+1] is a scan signal that is output to a row line (e.g., subsequent row line) next to (e.g., adjacent to) the row line to which the scan signal (S[i]) applied to the gate electrodes of the first switching transistor M1 and the second driving voltage transistor M4 is applied. In this case, the write driver 400 may be omitted from the display device of FIG. 1.

Figure 9:
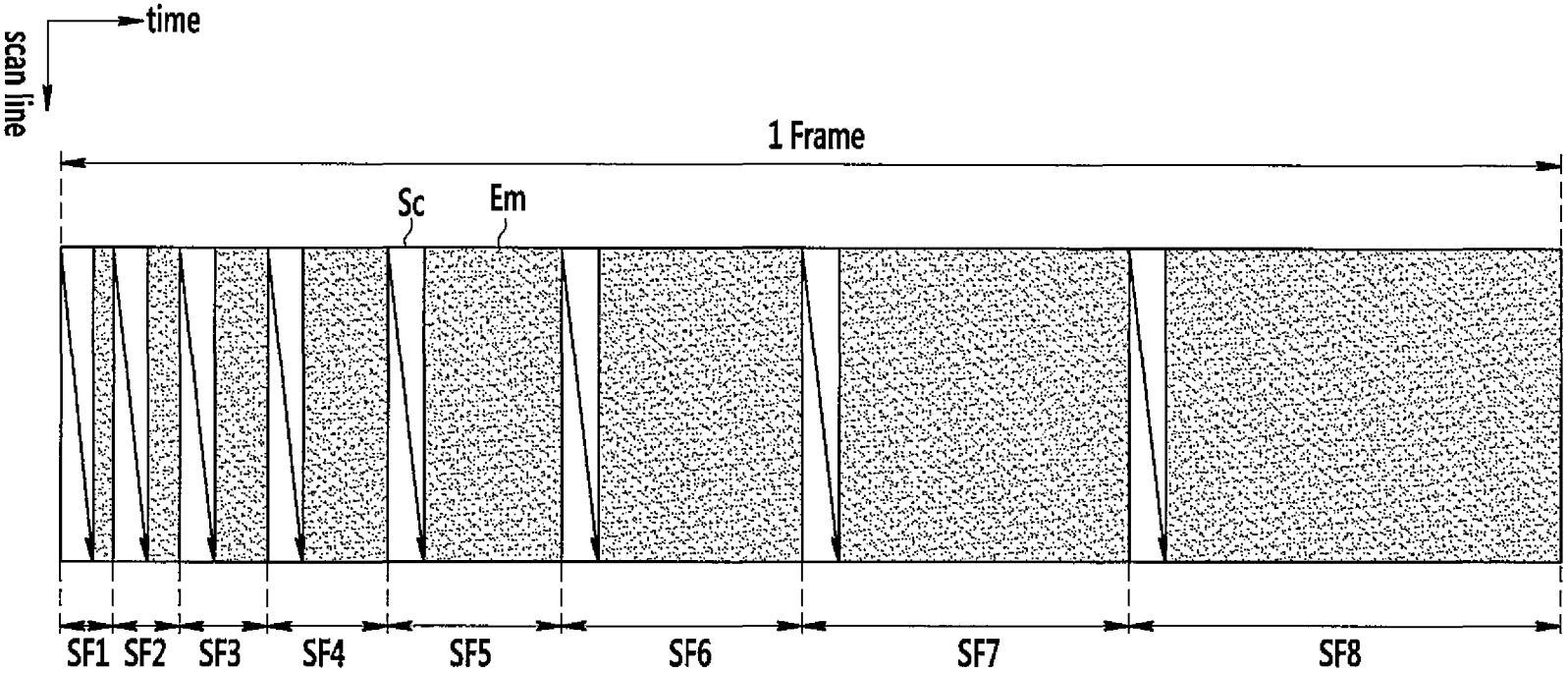
FIG. 9 shows an example diagram of a method for driving a display device according to an example embodiment of the present invention.

FIG. 9 shows an example diagram of a method for driving a display device according to an example embodiment of the present invention.

Referring to FIG. 9, the display device driven by the digital driving scheme according to an embodiment of the present invention displays an image for each frame including a plurality of sub-fields (SF1 to SF8). Each frame has been described to include eight sub-fields (SF1 to SF8) herein. However, the present invention is not limited thereto, and the number of sub-fields may vary depending on the resolution of the display device.

Each of the sub-fields (SF1 to SF8) includes a scan period (Sc) and an emission period (Em), respectively. As shown with reference to FIG. 3 and FIG. 7, the data signal with a white voltage or a black voltage is applied to a plurality of pixels during the scan period (Sc) of each of the sub-fields (SF1 to SF8). During the scan period (Sc), the second power voltage (ELVSS) is applied with the same voltage as the first power voltage (ELVDD), and the plurality of pixels emit no light. During the emission period (Em), the second power voltage (ELVSS) is changed to the low level voltage. When the second power voltage (ELVSS) is changed to the low level voltage, the pixels to which the data signal having the white voltage is applied emit light concurrently (e.g., simultaneously).

The emission periods (Em) of the plurality of sub-fields (SF1 to SF8) are different from each other, and a gray level (e.g., grayscale level) of a corresponding pixel is expressed by a sum of the emission periods during which the pixel emits light of the sub-fields (SF to SF8). For example, the emission period (Em) of the first sub-field SF1 may be a first period that corresponds to a first gray level, the emission period (Em) of the second sub-field SF2 may be a second period that corresponds to a second gray level, the emission period (Em) of the third sub-field SF3 may be a fourth period that corresponds to a fourth gray level, the emission period (Em) of the fourth sub-field SF4 may be an eighth period that corresponds to an eighth gray level, the emission period (Em) of the fifth-sub field SF5 may be a sixteenth period that corresponds to a sixteenth gray level, the emission period (Em) of the sixth sub-field SF6 may be a thirty-second period that corresponds to a thirty-second gray level, the emission period (Em) of the seventh sub-field SF7 may be a sixty-fourth period that corresponds to a sixty-fourth gray level, and the emission period (Em) of the eighth sub-field SF8 may be a one hundred-twenty-eighth period that corresponds to a one hundred-twenty-eighth gray level. The 256 grays can be expressed by the sum of the emission periods (Em) of the pixels in the first to eighth sub-fields (SF1 to SF8).

The voltage difference between the minimum voltage and the maximum voltage of the data signal of the display device using the conventional digital driving scheme, that is, a voltage range, is 10 V. In contrast, the voltage range of the data signal of the display device using the proposed digital driving scheme according to an embodiment of the present invention is 5 V or about 5 V.

In the digital driving scheme, power consumption (P) for driving the display device becomes P=CV2f. Here, C is capacitance of the data line, V is a voltage range of the data signal, and f is an operation frequency. The example digital driving scheme according to an embodiment of the present invention, compared to the existing digital driving scheme, reduces the voltage range of the data signal to ½, so power consumption needed for driving the display device according to the proposed digital driving scheme is reduced to ¼. Since power consumption is reduced, there is no need to increase the wiring thickness of the scan line and the data line for the input time margin of the data signal. Accordingly, the time for manufacturing the display device is reduced and productivity is improved.

It is possible to control the capacitance of the first capacitor C1 to be very small in the pixel of FIG. 2 in order to improve integrity of the pixel in the display device. In addition, in order to further reduce power consumption (P) for driving the display device, the voltage range of the data signal may be controlled to be less than 3 V. For example, the bootstrap operation by the first capacitor C1 is completely performed, which may take a time that is longer than the first horizontal period 1H.

Figure 10:
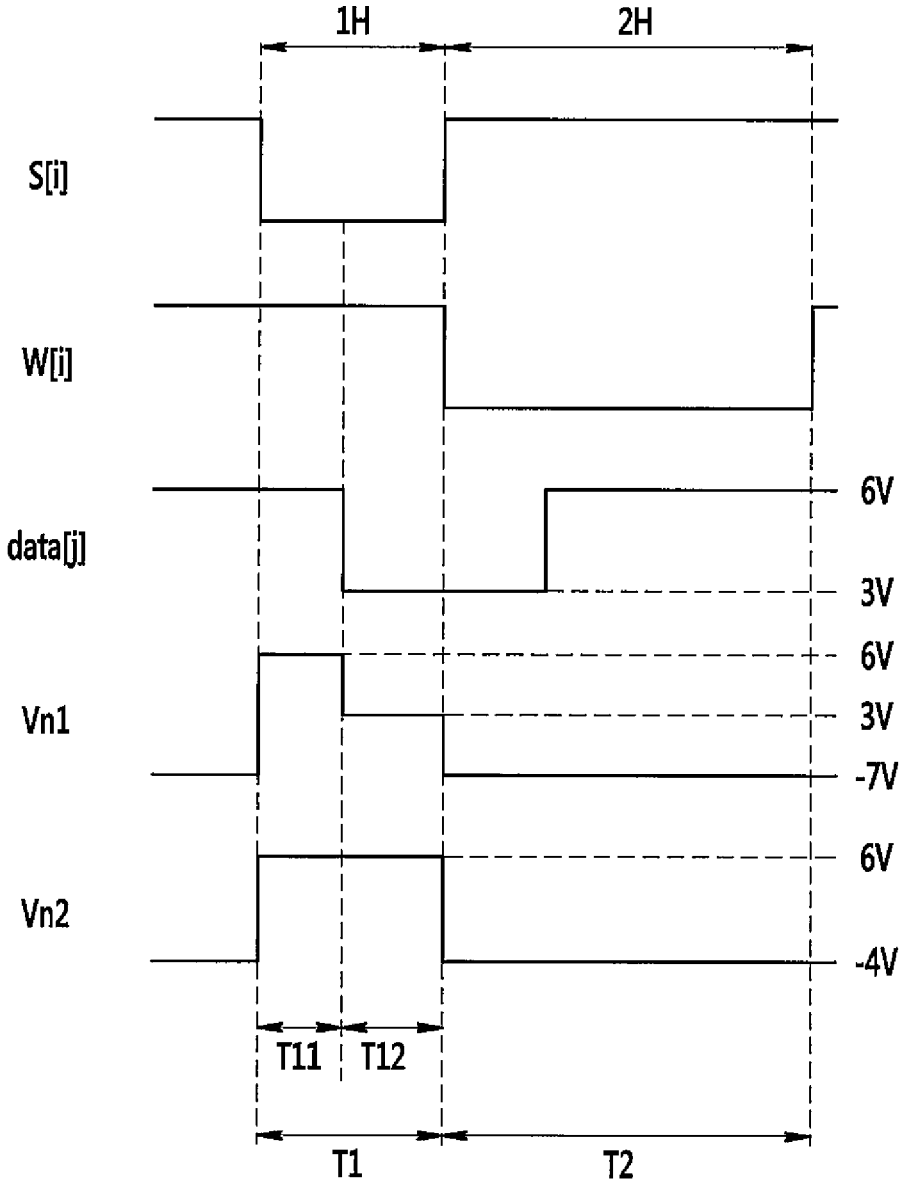
FIG. 10 shows a timing diagram for an operation of applying a data signal with a white voltage to a pixel according to another example embodiment of the present invention.

In this case, as shown in FIG. 10, it is possible to completely perform the bootstrap operation by the first capacitor C1 by increasing the data write period T2 to be greater than the reset period T1. That is, the data write period T2 may have a period that is longer than the reset period T1.

FIG. 10 shows a timing diagram for an operation of applying a data signal with a white voltage to a pixel according to another example embodiment of the present invention.

Compared to FIG. 3, the black voltage becomes 6 V and the white voltage becomes 3 V so the voltage range of the data signal (data[j]) becomes 3 V. Accordingly, in the second reset period T12, the voltage Vn1 at the first node N1 becomes 3 V. In the data write period T2, the voltage Vn1 at the first node N1 becomes −7 V by a bootstrap effect caused by the first capacitor C1. Compared to the case in which the voltage Vn1 at the first node N1 becomes −9 V by the bootstrap effect caused by the first capacitor C1 as shown in FIG. 3, the case in which the voltage Vn1 at the first node N1 becomes −7 V requires much time to turn on the first driving voltage transistor M3. In this instance, the time for completely performing the bootstrap operation caused by the first capacitor C1 may be acquired by setting the data write period T2 as a second horizontal period 2H.

Compared to the conventional digital driving scheme, the voltage range of the data signal is reduced to 3/10, and power consumption for driving the display device is reduced to 9/100.

Figure 11:
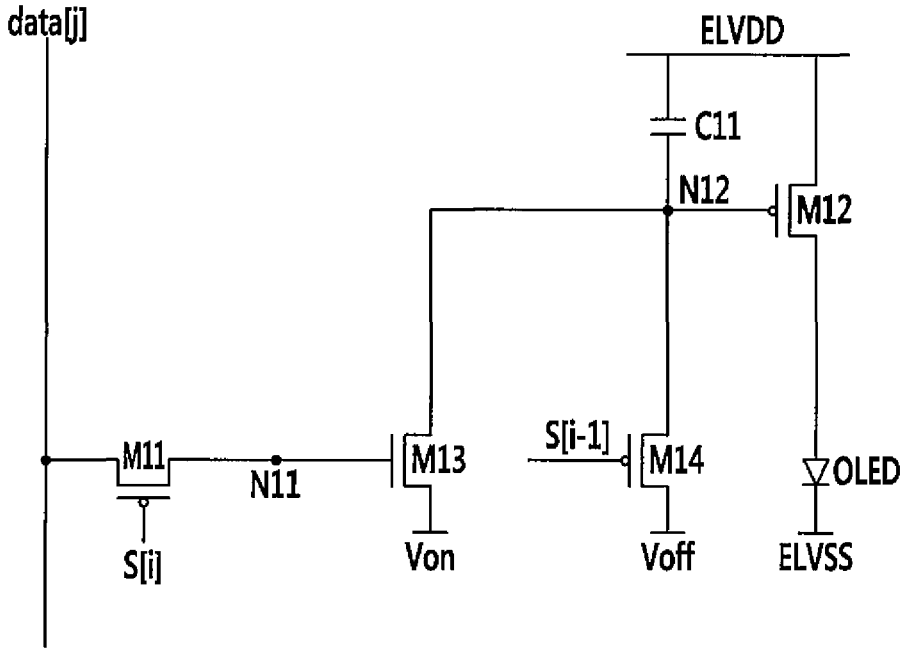
FIG. 11 shows a circuit diagram of a pixel according to another example embodiment of the present invention.

FIG. 11 shows a circuit diagram of a pixel according to another example embodiment of the present invention. A pixel provided on the i-th row and the j-th column is illustrated ($1 \le i \le n$, $1 \le j \le m$).

Referring to FIG. 11, the pixel includes a first switching transistor M11, a second switching transistor M12, a first driving voltage transistor M13, a second driving voltage transistor M14, a first capacitor C11, and an organic light emitting diode (OLED).

The first switching transistor M1 includes a gate electrode coupled (e.g., connected) to a scan line, a first electrode coupled to a data line, and a second electrode coupled to a first node N11. The first switching transistor M11 is turned on by a scan signal (S[i]) applied to the scan line and applies a data signal (data[j]) to the first node N11.

The second switching transistor M12 includes a gate electrode coupled to a second node N12, a first electrode coupled to a first power voltage (ELVDD), and a second electrode coupled to the organic light emitting diode (OLED). The second switching transistor M12 is turned on by a voltage at the second node N12, and then applies the first power voltage (ELVDD) to the organic light emitting diode (OLED).

The first driving voltage transistor M13 includes a gate electrode coupled to the first node N11, a first electrode coupled to a first driving voltage Von, and a second electrode coupled to the second node N12. The first driving voltage transistor M13 is turned on by a voltage Vn1 at the first node N11 and applies the first driving voltage Von to the second node N12.

The second driving voltage transistor M14 includes a gate electrode coupled to a scan line (e.g., a previous scan line), a first electrode coupled to a second driving voltage Voff, and a second electrode coupled to the second node N12. The second driving voltage transistor M14 is turned on by a scan signal (S[i−1]) (e.g., a previous scan signal) applied to the scan line, and applies the second driving voltage Voff to the second node N12.

The scan line coupled to the gate electrode of the second driving voltage transistor M14 is a scan line that is arranged prior to the scan line coupled to the gate electrode of the first switching transistor M11 by one row. That is, the scan signal (S[i−1]) is applied to the gate electrode of the second driving voltage transistor M14 in advance of the time when the scan signal (S[i]) is applied to the gate electrode of the first switching transistor M11 by one row.

The first driving voltage transistor M13 is a transistor with a channel that is different from the first switching transistor M11, the second switching transistor M12, and the second driving voltage transistor M14. That is, the first switching transistor M11, the second switching transistor M12, and the second driving voltage transistor M14 are p-channel electric field effect transistors, and the first driving voltage transistor M13 is an n-channel electric field effect transistor.

The first capacitor C11 includes a first electrode coupled to the first power voltage (ELVDD) and a second electrode coupled to the second node N12.

The organic light emitting diode (OLED) includes an anode coupled to the second electrode of the second switching transistor M12, and a cathode coupled to a second power voltage (ELVSS). The organic light emitting diode (OLED) may emit light of one of the primary colors. The primary colors may include red, green, and blue, and a desired color may be expressed by a spatial or temporal sum of these three primary colors.

An operation for applying a data signal with a white voltage to a pixel of FIG. 11 and an operation for applying a data signal with a black voltage thereto will now be described with reference to FIG. 12 and FIG. 13.

Figure 12:
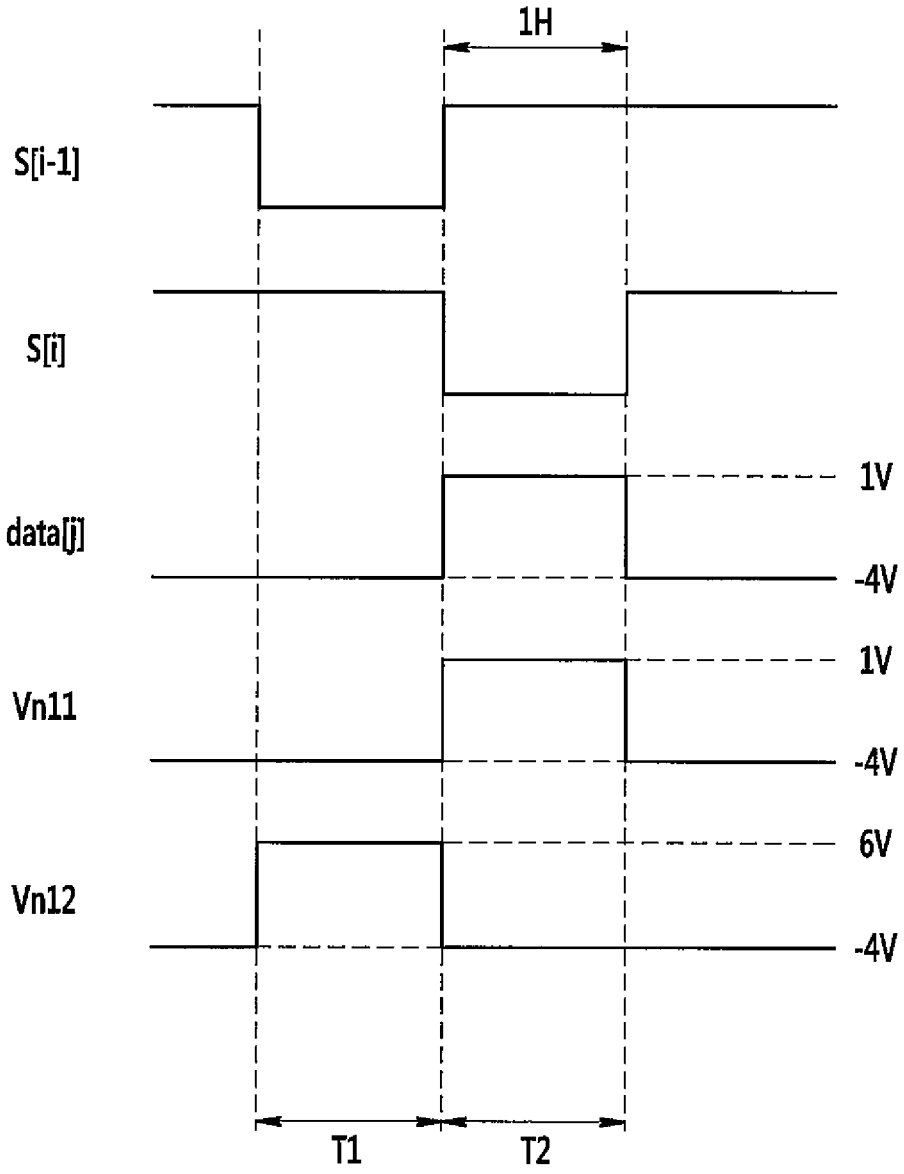
FIG. 12 shows a timing diagram for an operation of applying a data signal with a white voltage to a pixel according to another example embodiment of the present invention.

FIG. 12 shows a timing diagram for an operation of applying a data signal with a white voltage to a pixel according to another example embodiment of the present invention.

Referring to FIG. 12, during the reset period T1, the first scan signal (S[i−1]) is applied as a gate-on voltage, and the second scan signal (S[i]) is applied as a gate-off voltage. The first scan signal (S[i−1]) is a signal applied to the scan line arranged prior to the second scan signal (S[i]) by one row. The data signal (data[j]) may be applied as a black voltage. The black voltage is a low level voltage, which may be −4 V, for turning off the first driving voltage transistor M13, and the white voltage is a high level voltage, which may be 1 V, for turning on the first driving voltage transistor M13. When the first scan signal (S[i−1]) is applied as a gate-on voltage, the second driving voltage transistor M14 is turned on. The second driving voltage Voff is applied to the second node N12 through the turned on second driving voltage transistor M14. When the second driving voltage Voff is 6 V, the voltage Vn12 at the second node N12 becomes 6 V.

During the data write period T2, the first scan signal (S[i−1]) is applied as a gate-off voltage, and the second scan signal (S[n]) is applied as a gate-on voltage. The data signal (data[j]) is applied as a white voltage. When the first scan signal (S[i−1]) is applied as a gate-off voltage, the second driving voltage transistor M14 is turned off. When the second scan signal (S[n]) is applied as a gate-on voltage, the first switching transistor M11 is turned on. The data signal (data[j]) having the white voltage is applied to the first node N11 through the turned on first switching transistor M11, and the voltage Vn11 at the first node N11 becomes 1 V. The first driving voltage transistor M13 is turned on by the voltage Vn11 at the first node N11. The first driving voltage Von is applied to the second node N12 through the turned on first driving voltage transistor M13. When the first driving voltage is −4 V, the voltage Vn12 at the second node N12 becomes −4 V. The voltage Vn12 at the second node N12 is stored in the first capacitor C11, and maintains the second switching transistor M12 in the turned on state. When the second switching transistor M12 is turned on by the voltage Vn12 at the second node N12, a current flows to the organic light emitting diode (OLED) from the first power voltage (ELVDD), and the organic light emitting diode (OLED) emits light.

Figure 13:
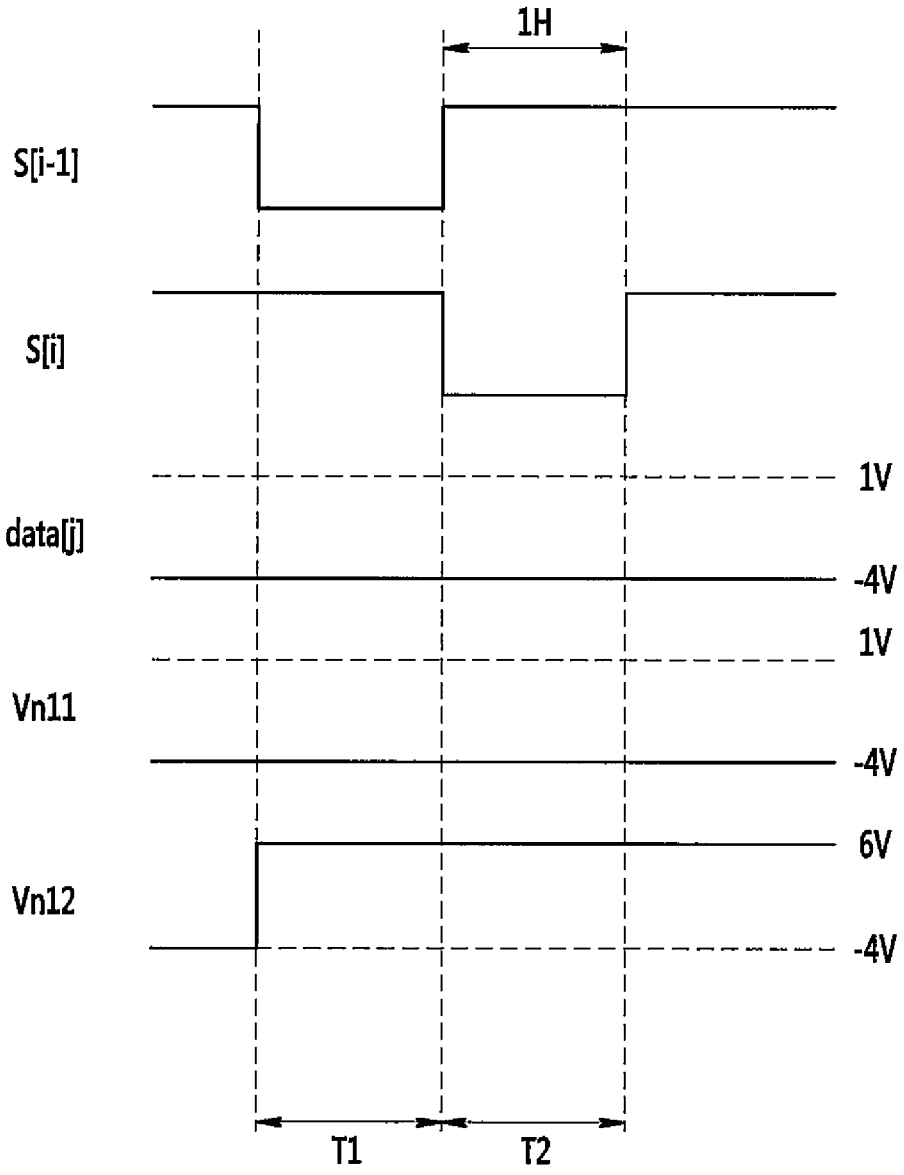
FIG. 13 shows a timing diagram for an operation of applying a data signal with a black voltage to a pixel according to another example embodiment of the present invention.

FIG. 13 shows a timing diagram for an operation of applying a data signal with a black voltage to a pixel according to another example embodiment of the present invention.

Referring to FIG. 13, during the reset period T1, the first scan signal (S[i−1]) is applied as a gate-on voltage, and the second scan signal (S[i]) is applied as a gate-off voltage. During the data write period T2, the first scan signal (S[i−1]) is applied as a gate-off voltage, and the second scan signal (S[i]) is applied as a gate-on voltage. In this case, the data signal (data[j]) is applied with −4 V, a black voltage, during the reset period T1 and the data write period T2.

During the reset period T1, the second driving voltage transistor M14 is turned on. The second driving voltage Voff is applied to the second node N12 through the turned on second driving voltage transistor M14, and the voltage Vn12 at the second node N12 becomes 6 V.

During the data write period T2, the second driving voltage transistor M14 is turned off and the first switching transistor M11 is turned on. The data signal (data[j]) is applied to the first node N11 through the turned on first switching transistor M11, and the voltage Vn11 at the first node N11 becomes −4 V, a low level voltage for turning off the first driving voltage transistor M13. The first driving voltage transistor M13 maintains the turn off state. The voltage Vn12 at the second node N12 is maintained at 6 V and the second switching transistor M12 is turned off. Therefore, no current flows to the organic light emitting diode (OLED) from the first power voltage (ELVDD).

The pixel of FIG. 11 needs a process for manufacturing an n-channel electric field effect transistor in addition to the process for manufacturing the p-channel electric field effect transistor compared to the pixel of FIG. 2, but the pixel of FIG. 11 can be integrated in a small area because there are less transistors and capacitors configuring the pixel, and a driving operation of the pixel is simplified because a bootstrap time is not needed.

At least one of a plurality of transistors included in the pixel of FIG. 2 and FIG. 11 may be an oxide thin film transistor (oxide TFT) in which a semiconductor layer is configured with an oxide semiconductor.

The oxide semiconductor may include one oxide based on titanium (Ti), hafnium (Hf), zirconium (Zr), aluminum (Al), tantalum (Ta), germanium (Ge), zinc (Zn), gallium (Ga), tin (Sn), or indium (In), and complex oxides thereof such as zinc oxide (ZnO), indium-gallium-zinc oxide (InGaZnO4), indium zinc oxide (In—Zn—O), zinc-tin oxide (Zn—Sn—O), indium gallium oxide (In—Ga—O), indium-tin oxide (In—Sn—O), indium-zirconium oxide (In—Zr—O), indium-zirconium-zinc oxide (In—Zr—Zn—O), indium-zirconium-tin oxide (In—Zr—Sn—O), indium-zirconium-gallium oxide (In—Zr—Ga—O), indium-aluminum oxide (In—Al—O), indium-zinc-aluminum oxide (In—Zn—Al—O), indium-tin-aluminum oxide (In—Sn—Al—O), indium-aluminum-gallium oxide (In—Al—Ga—O), indium-tantalum oxide (In—Ta—O), indium-tantalum-zinc oxide (In—Ta—Zn—O), indium-tantalum-tin oxide (In—Ta—Sn—O), indium-tantalum-gallium oxide (In—Ta—Ga—O), indium-germanium oxide (In—Ge—O), indium-germanium-zinc oxide (In—Ge—Zn—O), indium-germanium-tin oxide (In—Ge—Sn—O), indium-germanium gallium oxide (In—Ge—Ga—O), titanium-indium-zinc oxide (Ti—In—Zn—O), and hafnium-indium-zinc oxide (Hf—In—Zn—O).

The semiconductor layer includes a channel area in which impurities are not doped, and a source area and a drain area in which impurities are doped at respective sides of the channel area. Herein, the impurities vary according to a kind of thin film transistor, and may be N-type impurities or P-type impurities.

When the semiconductor layer is formed of the oxide semiconductor, a separate passivation layer may be added in order to protect the oxide semiconductor, which may be vulnerable to the external environment such as exposure to a high temperature.

The accompanying drawings and the example embodiments of the present invention are only examples, and are used only to describe aspects of the present invention, but should not be construed as limiting the spirit or scope of the present invention as defined by the following claims, and their equivalents. Thus, it will be understood by those of ordinary skill in the art that various modifications and equivalent embodiments may be made. Therefore, the spirit and scope of the present invention may be defined by the following claims, and their equivalents.

What is claimed is:

1. A display device comprising:

a plurality of pixels, each of the pixels comprising:

a first switching transistor comprising a gate electrode directly coupled to a scan line, a first electrode directly coupled to a data line, and a second electrode directly coupled to a first node;

a first driving voltage transistor comprising a gate electrode directly coupled to the first node, and a first electrode directly coupled to a first driving voltage;

a write transistor comprising a gate electrode directly coupled to a write line, a first electrode directly coupled to a second electrode of the first driving voltage transistor, and a second electrode directly coupled to a second node;

a second switching transistor comprising a gate electrode directly coupled to the second node, a first electrode directly coupled to a first power voltage, and a second electrode directly coupled to an organic light emitting diode; and a first capacitor comprising a first electrode directly coupled to the first node and a second electrode directly coupled to the second node, wherein each of the pixels further comprises:

a second driving voltage transistor comprising a gate electrode directly coupled to the scan line, a first electrode directly coupled to a second driving voltage, and a second electrode directly coupled to the second node.

2. The display device of claim 1, wherein each of the pixels further comprises a second capacitor comprising a first electrode directly coupled to the first power voltage and a second electrode directly coupled to the second node.

3. The display device of claim 2, wherein the first driving voltage is a gate-on voltage for turning on the second switching transistor.

4. The display device of claim 3, wherein the second driving voltage is a gate-off voltage for turning off the second switching transistor.

5. The display device of claim 1, wherein a data signal with a white voltage for turning on the first driving voltage transistor or a black voltage for turning off the first driving voltage transistor is applied to the data line.

6. The display device of claim 5, wherein:

during a reset period, a scan signal with a gate-on voltage is applied to the scan line and the data signal is applied to the data line, and during a data write period, a scan signal with a gate-off voltage is applied to the scan line and a write signal is applied as a gate-on voltage to the write line.

7. The display device of claim 6, wherein when the data signal is applied as the white voltage, a voltage at the first node is changed to a voltage for turning on the first driving voltage transistor by a bootstrap effect caused by the first capacitor during the data write period.

8. The display device of claim 7, wherein the reset period and the data write period have the same period.

9. The display device of claim 8, wherein the write signal is another scan signal that is output to a row line next to a row line to which the scan signal is applied.

10. The display device of claim 6, wherein a second power voltage directly coupled to a cathode of the organic light emitting diode is applied as a same voltage as the first power voltage during the data write period, and after the data write period, the second power voltage is changed and the organic light emitting diode emits light.

* * * * *